US008217840B2

(12) United States Patent
Chen et al.

(10) Patent No.: US 8,217,840 B2
(45) Date of Patent: Jul. 10, 2012

(54) DUAL-BAND ANTENNA ASSEMBLY

(75) Inventors: Min Chen, Shanghai (CN); Cho-Ju Chung, Taipei Hsien (TW)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 399 days.

(21) Appl. No.: 12/627,014

(22) Filed: Nov. 30, 2009

(65) Prior Publication Data

US 2011/0050538 A1 Mar. 3, 2011

(30) Foreign Application Priority Data

Aug. 26, 2009 (CN) ..... 2009 2 0308926 U

(51) Int. Cl.
*H01Q 1/38* (2006.01)

(52) U.S. Cl. ..... 343/700 MS; 343/893; 343/895; 343/853

(58) Field of Classification Search ..... None
See application file for complete search history.

(56) References Cited

U.S. PATENT DOCUMENTS

| | | | | |
|---|---|---|---|---|
| 7,199,755 | B2 * | 4/2007 | Belhora | 343/700 MS |
| 7,414,583 | B2 * | 8/2008 | Choi et al. | 343/700 MS |
| 7,839,339 | B2 * | 11/2010 | Phillips et al. | 343/700 MS |
| 2002/0186171 | A1 | 12/2002 | Petros | |
| 2004/0056803 | A1 * | 3/2004 | Soutiaguine et al. | 343/700 MS |
| 2004/0080457 | A1 * | 4/2004 | Guo et al. | 343/700 MS |
| 2006/0044187 | A1 * | 3/2006 | Sager et al. | 343/700 MS |

* cited by examiner

*Primary Examiner* — Trinh Dinh
(74) *Attorney, Agent, or Firm* — Altis Law Group, Inc.

(57) ABSTRACT

A dual-band antenna assembly is positioned on a substrate, and includes an insulation body, a plane antenna and a microstrip antenna. The insulation body includes a plane surface paralleled to the substrate, and a side surface perpendicularly extending from edges of the plane surface to the substrate. The plane antenna includes a first feed portion and a first radiator. The first feed portion passes through the substrate to the plane surface of the insulation body. The first radiator is substantially positioned on a center of the plane surface of the insulation body, and electrically connected to the first feed portion. The microstrip antenna includes a second feed portion and a second radiator. The second radiator is a microstrip, electrically connected to the second feed portion and positioned on the side surface of the insulation body.

9 Claims, 4 Drawing Sheets

DUAL-BAND ANTENNA ASSEMBLY

RELATED APPLICATION

This application claims priority under 35 U.S.C. 119 to an application CHINA 200920308926.1 filed on Aug. 26, 2009, the contents of which are incorporated herein by reference.

BACKGROUND

1. Technical Field

Embodiments of the present disclosure relate to antennas, and especially to a dual-band antenna assembly.

2. Description of Related Art

Nowadays, miniature consumer electronic products integrate frequency modulation (FM) with global position system (GPS). A structure is simple to allow assembly of antennas with different frequency bands, but the distance between the antennas, using the method mentioned above interferes with demand for greater miniaturization.

Therefore, design of a dual-band antenna assembly to meet frequency band needs and miniaturization demands has proven to be a significant challenge in the industry.

DETAILED DESCRIPTION

Figure 1:
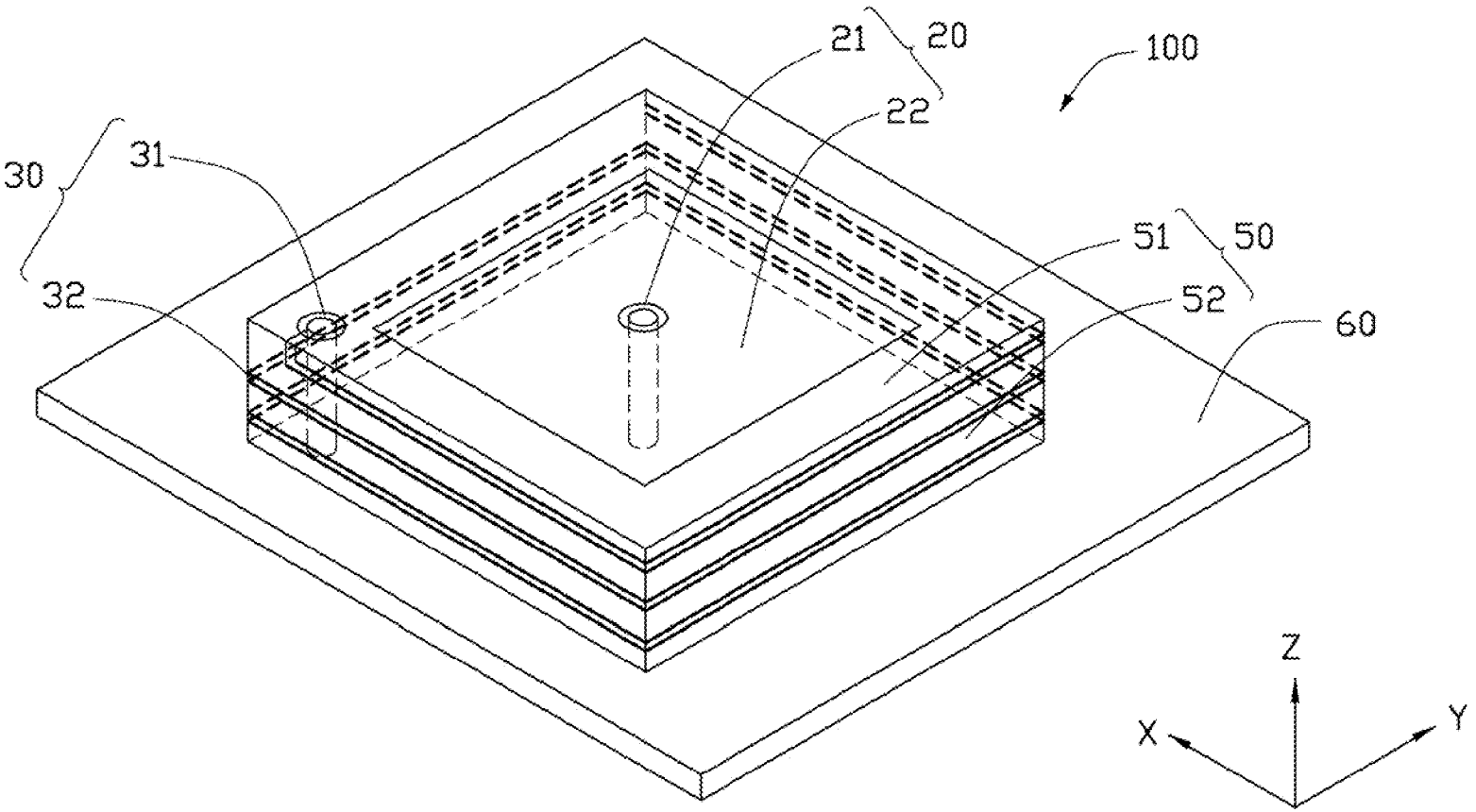
FIG. 1 is a schematic diagram of one embodiment of a dual-band antenna assembly according to the present disclosure.

Referring to FIG. 1, a schematic diagram of a dual-band antenna assembly 100 as disclosed is shown. The dual-band antenna 100 is positioned on a substrate 60, and comprises an insulation body 50, a plane antenna 20, and a microstrip antenna 30.

The insulation body 50 is positioned on the substrate 60, and comprises a plane surface 51 and having four side surfaces, such as a side surface 52. The plane surface 51 is parallel to the substrate 60, the side surface 52 perpendicularly extends from edges of the plane surface 51 to the substrate 60. In one embodiment, the insulation body 50 may be ceramic having a high dielectric constant. The insulation body 50 may be cubical in shape, in one embodiment.

The plane antenna 20 comprises a first feed portion 21 and a first radiator 22.

The first feed portion 21 passes from the substrate 60 through the insulation body 50 to the plane surface 51, to feed first electromagnetic signals. In one embodiment, the feed portion 21 may be a radio frequency (RF) cable.

The first radiator 22 is positioned on a center of the plane surface 51 of the insulation body 50, and electrically connected to the first feed portion 21 to radiate the first electromagnetic signals. In one embodiment, the first radiator 22 is rectangular but may be round or other shapes. The area of the first radiator 22 is smaller than the area of the plane surface 51 of the insulation body 50.

The microstrip antenna 30 comprises a second feed portion 31 and a second radiator 32.

The second feed portion 31 is positioned to feed a second electromagnetic signals. In one embodiment, the second feed portion 31 is parallel to the first feed portion 21, and passes from the substrate 60 through the insulation body 50 to the plane surface 51.

The second radiator 32 is a micro strip, and positioned on the side surface 52 of the insulation body 50. The second radiator 32 is electrically connected to the second feed portion 32 to radiate the second electromagnetic signals. In one embodiment, the second radiator 32 is helically coiled around the side surface 52 of the insulation body 50 extending from the plane surface 51 of the insulation body 50 to the substrate 60.

In one embodiment, an electric field direction of the first radiator 22 is perpendicular to the substrate 60, and an electric field direction of the second radiator 32 is parallel to the substrate 60. That is, the electric field direction of the first radiator 22 is perpendicular to that of the second radiator 32. Therefore, the electromagnetic signals will not disrupt or interfere with each other, and assembly on the insulation body 50, to save space of the dual-band antenna assembly 100.

Figure 2:
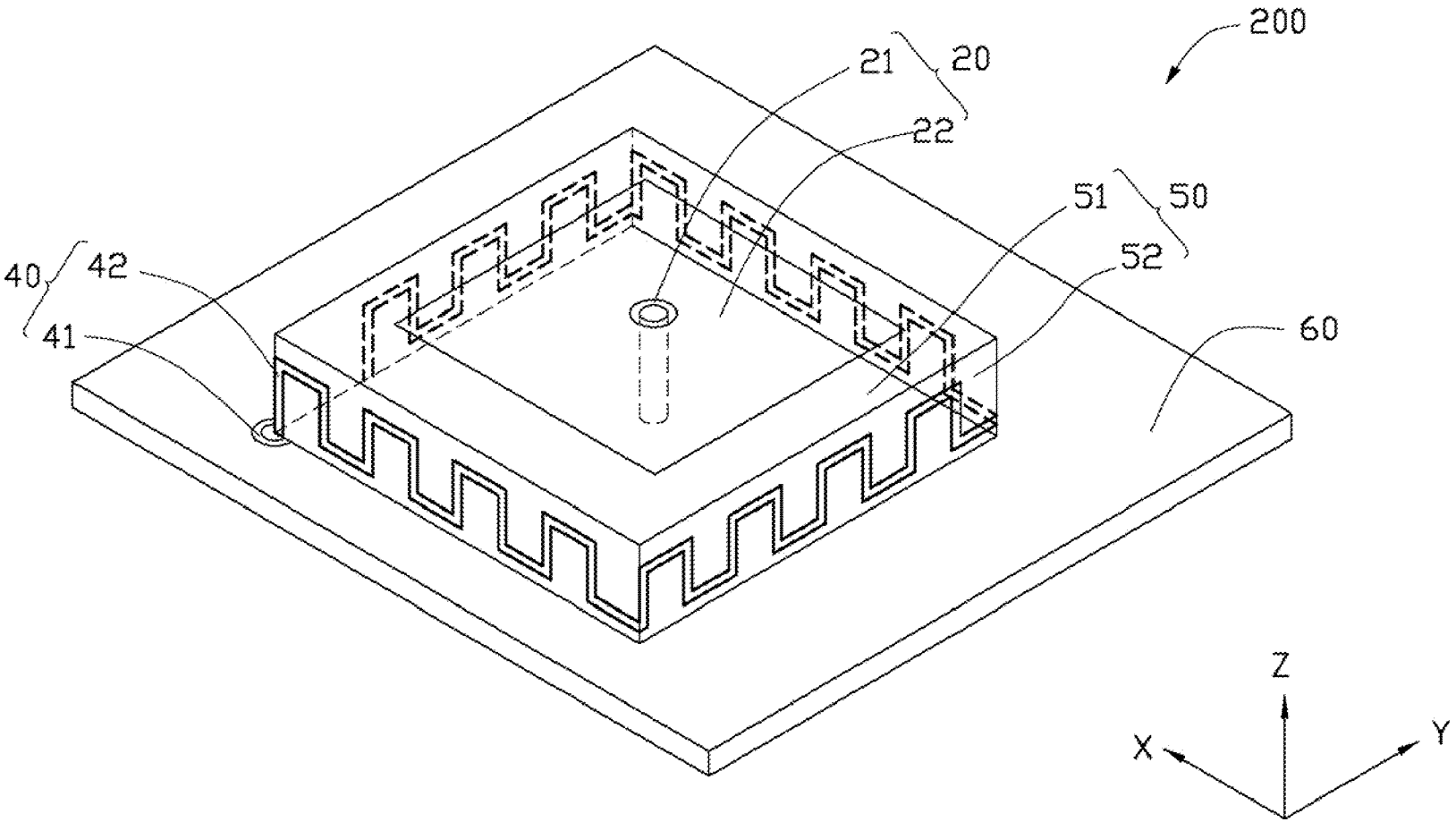
FIG. 2 is a schematic diagram of another embodiment of a dual-band antenna assembly according to the present disclosure.

FIG. 2, is a schematic diagram of a dual-band antenna assembly 200 as disclosed, differing from the dual-band antenna assembly 100 shown in FIG. 1 only in the microstrip antenna 40. The microstrip antenna 40 comprises a second feed portion 41 and a second radiator 42.

In one embodiment, the second feed potion 41 is a feed via positioned on the substrate 60, and clings to the side surface 52 of the insulation body 50.

The second radiator 42 is wave-shaped, and arranged around the side surface 52 of the insulation body 50. In one embodiment, an electric field direction of the second radiator 42 is parallel to the substrate 60, that is, the electric field direction of the first radiator 22 is perpendicular to that of the second radiator 42. Therefore, the electromagnetic signals will not disrupt or interfere with each other, and assembly on the insulation body 50, to save space of the dual-band antenna assembly 100.

Figure 3:
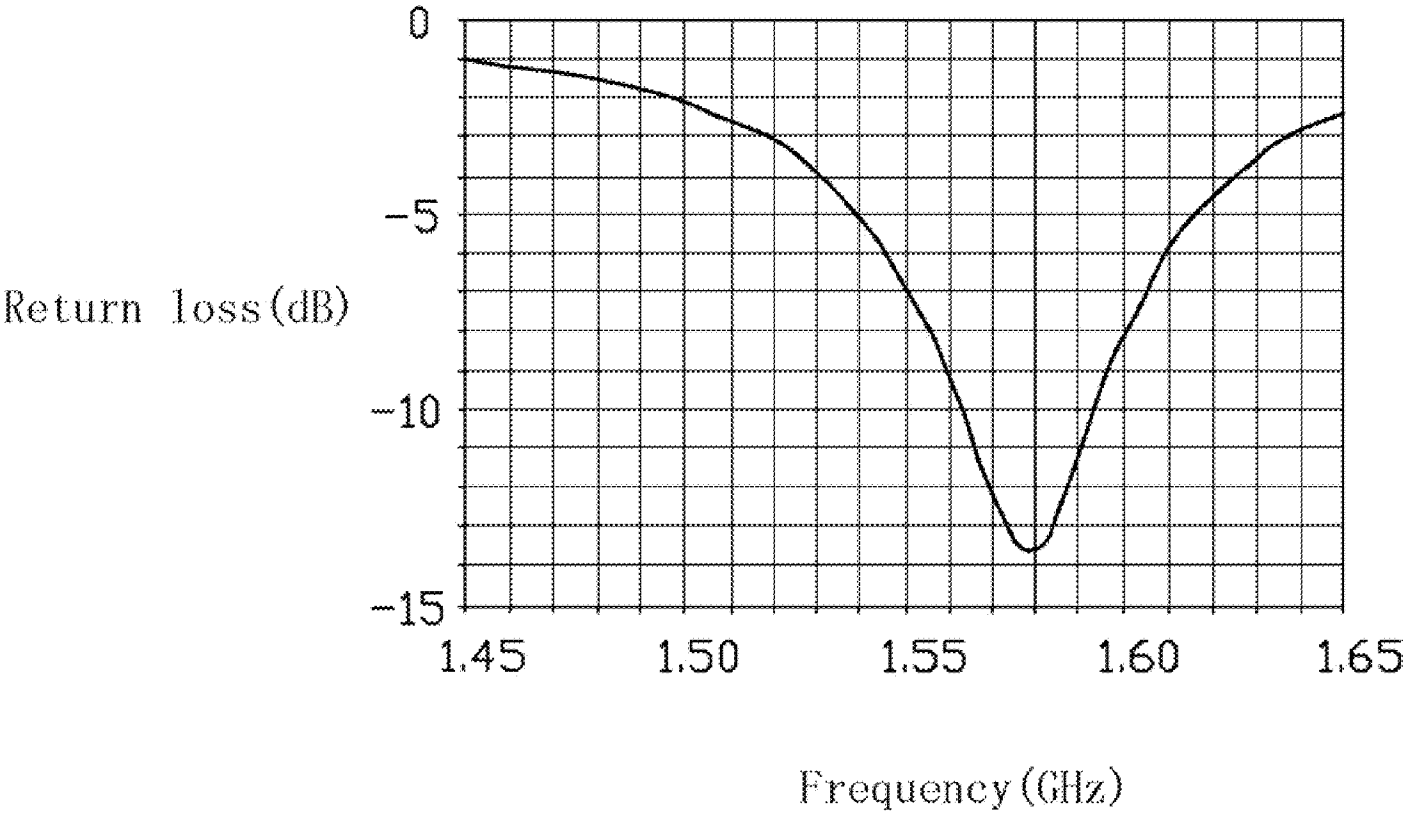
FIG. 3 is a graph showing an exemplary return loss of a plane antenna of the dual-band antenna assembly of FIG. 1.
Figure 4:
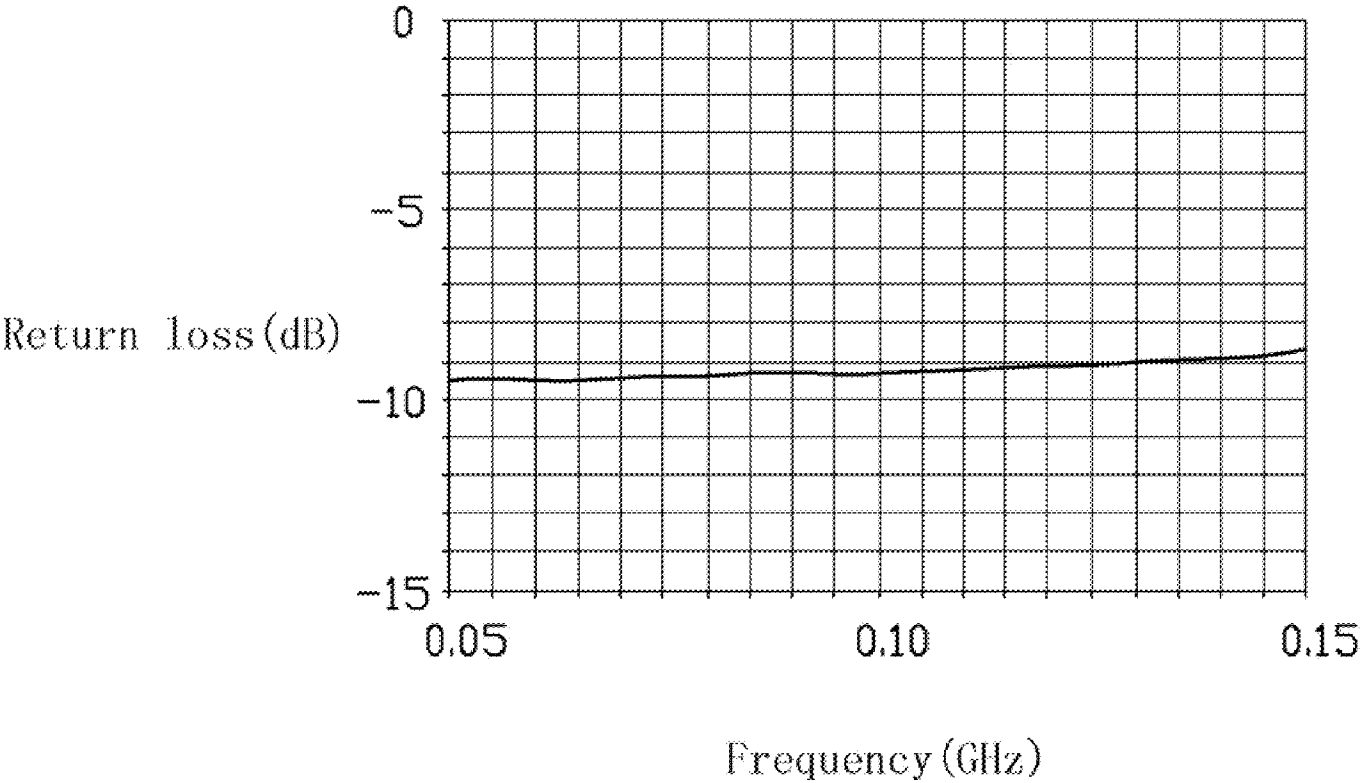
FIG. 4 is a graph showing an exemplary return loss of a microstrip antenna of the dual-band antenna assembly of FIG. 1.

Referring to FIG. 3 and FIG. 4, an exemplary return loss of the dual-band antenna assembly 100 is shown. As shown in FIG. 3, when the plane antenna 20 operates in approximately 1.57-1.59 GHz range, the return loss is less than −10 dB, which complies with GPS standards. As shown in FIG. 4, when the microstrip antenna 30 or 40 operates in a 88-108 MHz, range the return loss is less than −10 dB, which complies with FM standards.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A dual-band antenna assembly, positioned on a substrate, the dual-band antenna comprising:

an insulation body, positioned on the substrate, and comprising a plane surface parallel to the substrate, and a side surface perpendicularly extending from edges of the plane surface to the substrate;

a plane antenna, comprising:

a first feed portion, passing from the substrate through the insulation body to the plane surface, to feed a first electromagnetic signal; and a first radiator, substantially positioned on a center of the plane surface of the insulation body, and electrically connected to the first feed portion, to radiate the first electromagnetic signal; and a microstrip antenna, comprising:

a second feed portion, to feed a second electromagnetic signal; and a second radiator, being a microstrip, electrically connected to the second feed portion and positioned on the side surface of the insulation body, to radiate the second electromagnetic signal.

2. The dual-band antenna assembly as claimed in claim 1, wherein the insulation body is made of ceramic having a high dielectric constant.

3. The dual-band antenna assembly as claimed in claim 2, wherein the insulation body is cubical shaped.

4. The dual-band antenna assembly as claimed in claim 1, wherein the first feed portion and the second feed portion are radio frequency (RF) cables.

5. The dual-band antenna assembly as claimed in claim 4, wherein the second feed portion is parallel to the first feed portion, and passes from the substrate through the insulator to the plane surface.

6. The dual-band antenna assembly as claimed in claim 5, wherein the second radiator is helically coiled around the side surface of the insulation body.

7. The dual-band antenna assembly as claimed in claim 4, wherein the second radiator extends from the plane surface of the insulation body to substrate.

8. The dual-band antenna assembly as claimed in claim 1, wherein the first feed portion is a radio frequency (RF) cable, and wherein the second feed potion is a feed via positioned on the substrate, and clings to the side surface of the insulation body.

9. The dual-band antenna assembly as claimed in claim 8, wherein the second radiator is wave-shaped, arranged around the side surface of the insulation body.

* * * * *